US006793367B1

(12) United States Patent
Chan

(10) Patent No.: US 6,793,367 B1
(45) Date of Patent: Sep. 21, 2004

(54) LANTERN SUPPORT POST

(76) Inventor: Edmund Chan, 2114 Junction Ave., El Cerrito, CA (US) 94530-1730

( * ) Notice: Subject to any disclaimer, the term of this patent is extended or adjusted under 35 U.S.C. 154(b) by 0 days.

(21) Appl. No.: 10/608,622

(22) Filed: Jun. 26, 2003

(51) Int. Cl.[7] ..... F21L 4/00

(52) U.S. Cl. ..... 362/190; 362/285; 362/288; 362/403; 248/125.1

(58) Field of Search ..... 362/190–191, 362/431, 198, 285, 288, 403; 248/125.8, 132, 149

(56) References Cited

U.S. PATENT DOCUMENTS 3,740,024 A * 6/1973 Hellerich et al. ..... 256/51
3,998,418 A * 12/1976 Boulanger ..... 248/309.1
4,827,389 A * 5/1989 Crum ..... 362/388
4,870,543 A * 9/1989 Born et al. ..... 362/542

* cited by examiner

*Primary Examiner*—Alan Cariaso
*Assistant Examiner*—Ali Alavi

(57) ABSTRACT

Lantern Support Post with an upper support post, a lower support post, a friction sleeve and a ground stake tube. The upper support post is rigid and tubular and has a centrally located slit at the top. The lower support post is rigid and tubular and has a reduced connection portion at its top that slidably engages with the bottom of the upper support tube. The support stake is rigid and capable of being driven into the ground. The top of the support stake is capable of slidably inserting into the bottom of the lower support tube. The friction sleeve is capable of sliding onto the upper support post so that it can be adjusted to support the bottom lip of a standard camping lantern. A preferred embodiment includes the ground stake tube includes a top cap made of high impact plastic such as nylon or ABS.

4 Claims, 2 Drawing Sheets

LANTERN SUPPORT POST

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of lantern accessories and more specifically to a lantern support post. Camping lanterns are well known. They are used to shed light in darkened conditions in an area that has no provision for standard electric lamps. Camping lanterns come equipped with a handle the is located near the top of the lantern. It is generally a wire form that is crescent shaped where each end of the wire is bent inward to engage an aperture in the lantern thereby allowing the handle to rotate in a desired position. The handle allows the user to carry the lantern as well as to hang the lantern on the branch of a tree or the like thereby gaining maximum illuminating effect of the lantern. However, in some camping conditions, there are no convenient trees or other hanging means in the local vicinity thereby making it difficult to suspend the lantern in a high enough location to maximize its ability to illuminate.

BRIEF SUMMARY OF THE INVENTION

The primary object of the invention is to provide a support for a camping lantern so that it can be hung independently at a camp site or the like.

Another object of the invention is to provide a support for a camping lantern that can easily adapt to holding a variety of styles of lanterns.

Another object of the invention is to provide a support for a camping lantern that can be assembled from a plurality of poles so that it can be compactly stored and shipped.

A further object of the invention is to provide a support for a camping lantern that is easy to install.

Yet another object of the invention is to provide a support for a camping lantern that is easy to clean.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a lantern support post comprising: an upper support post, a lower support post, a friction sleeve, a ground stake tube, said upper support post being rigid and tubular and having a centrally located slit in a parallel disposition to the top of said upper support post, said lower support post being rigid and tubular and having a reduced connection portion at its top that slidably engages with the bottom of said upper support post, said support stake being rigid and capable of being driven into the ground, the top of said support stake capable of slidably inserting into the bottom of said lower support post, and said friction sleeve capable of frictionally sliding onto said upper support post so that it can be adjusted to support the bottom lip of a standard camping lantern.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerate or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
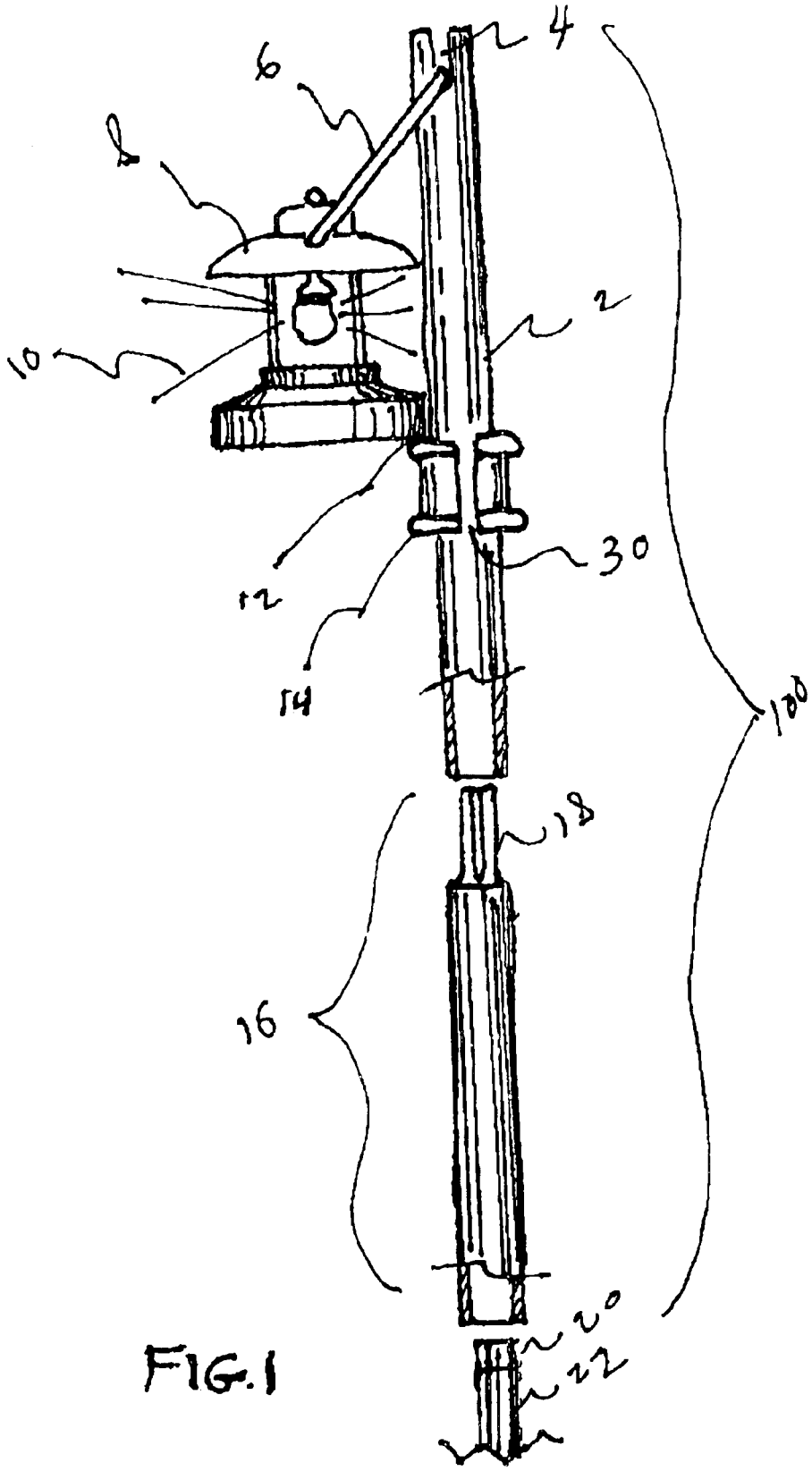
FIG. 1 is a side view of the present invention.
Figure 2:
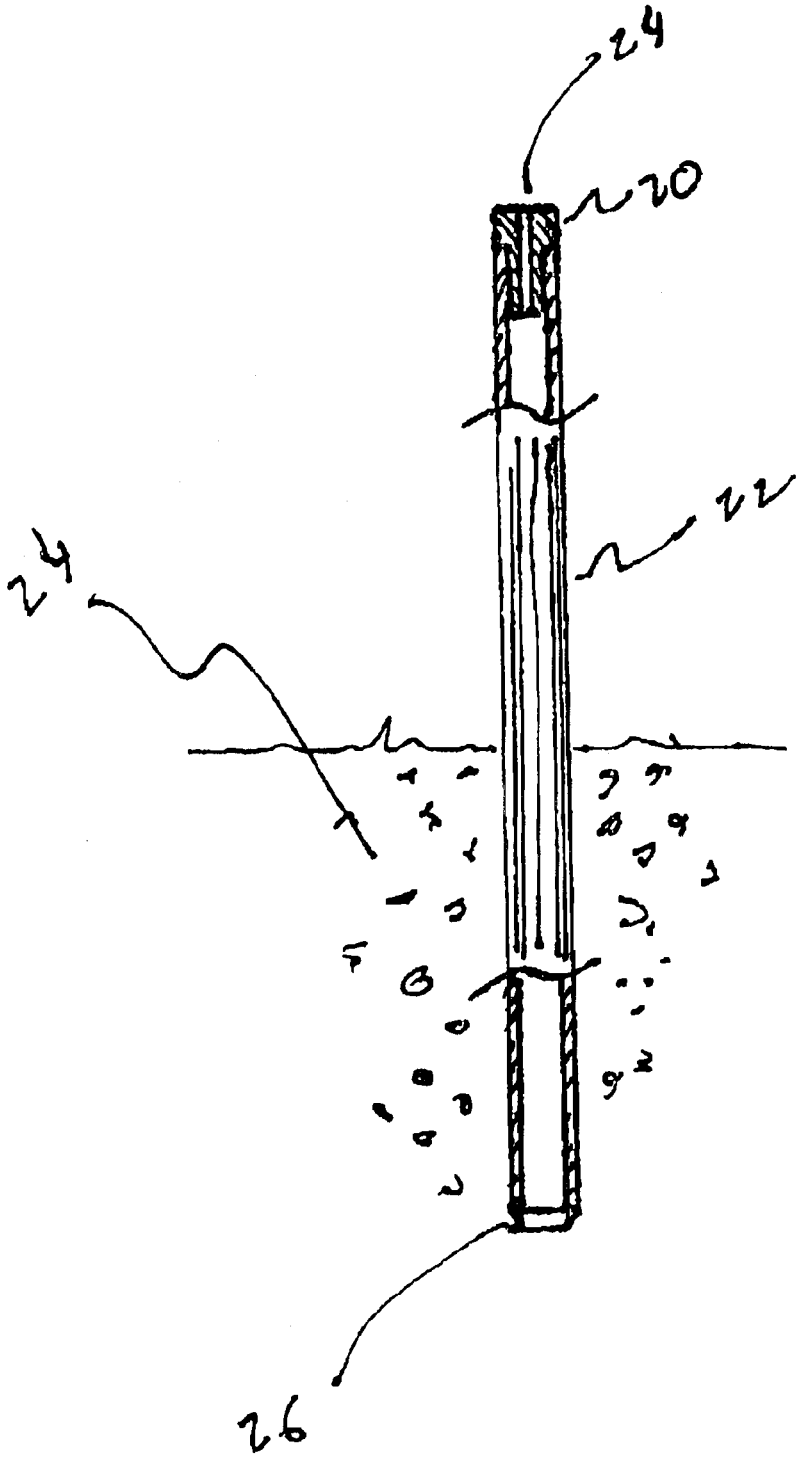
FIG. 2 is a side view of the ground stake of the present invention.

Referring now to FIG. 1 we see a side view of the lantern support post of the present invention 100. The upper support post 2 has a slit 4 at the top that is capable of removably retaining the handle 6 of a standard lantern 8 The upper support post is made of a rigid tube, for example aluminum or the like. A friction ring 14 is molded of a rigid plastic and because the ring 14 is slit 30, it has the ability to spring slightly so that when it slides onto upper support post 2, it remains in place without additional help. The friction ring is preferably made from a plastic such as nylon that remains springy and does not take a cold set. The ability to slide the friction ring 14 to any desired height on post 2 means that it can be adjusted to act as a ledge for the bottom edge of a standard lantern. The ledge portion of the friction ring may be slightly extended to further insure that is supports the bottom of the lantern 8. Lower support post 16 plugs into upper support post 2 by means of a reduced section 18 that is capable of sliding into the bottom of the upper post 2. A ground stake 22 and ground stake top cap 20 is shown in partial view. the lower support post 16 can slide onto the outside of ground stake 22 thereby holding the invention 100 in an upright position. FIG. 2 shows a side view of the complete ground stake 22 and stake cap 20. The ground stake 22 is made of rigid tubular material such as aluminum or steel or the like and has a sharpened bottom edge 26 to allow the ground stake to be driven into the ground more easily. Ground stake cap 20 is inserted into the top of the ground stake and is make of tough. rigid plastic such as ABS or nylon that can absorb the blows of a hammer without becoming distorted. A central aperture in ground stake cap 20 allows the user to clean out any dirt that may have collected in the ground stake 22. By using the present invention 100 the user can hang a lantern at an acceptable height so that light emanating from the lantern 10 can effectively illuminate a camping area. The present invention 100 can be disassembled for easy and compact transportation and storage. The overall assembly 100 is light weight and economical to produce.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Lantern Support Post comprising:

an upper support post;

a lower support post;

a friction sleeve;

a ground stake tube;

said upper support post being rigid and tubular and having a centrally located slit in a parallel disposition to the top of said upper support post;

said lower support post being rigid and tubular and having a reduced connection portion at its top that slidably engages with the bottom of said upper support tube;

said support stake being rigid and capable of being driven into the ground;

the top of said support stake capable of slidably inserting into the bottom of said lower support tube; and said friction sleeve capable of frictionally sliding onto said upper support post so that it can be adjusted to support the bottom lip of a standard camping lantern.

2. Lantern Support Post as claimed in claim 1 wherein said ground stake tube includes a top cap made of high impact plastic such as nylon or ABS that can withstand the blows of a hammer without major distortion.

3. Lantern Support Post as claimed in claim 2 wherein said high impact plastic cap includes a centrally located aperture so that the user can insert a rod to push out dirt that may have collected within said ground stake tube.

4. Lantern Support Post as claimed in claim 2 wherein the bottom perimeter of said ground stake tube is angled and sharpened to aid in the insertion of said ground stake tube into the ground.

* * * * *